United States Patent [19]

Wong

[11] Patent Number: 4,934,223

[45] Date of Patent: Jun. 19, 1990

[54] COMBINATION STRUCTURE OF UNIVERSAL TOOLS

[76] Inventor: Jason Wong, 28-2, Lane 232, Hu-lin Street, Taipei, Taiwan

[21] Appl. No.: 391,013

[22] Filed: Aug. 9, 1989

[51] Int. Cl.[5] ..... B25G 1/08

[52] U.S. Cl. ..... 81/490; 81/177.4

[58] Field of Search ..... 81/177.4, 490; 7/167

[56] References Cited

U.S. PATENT DOCUMENTS 4,627,315 12/1986 Lin ..... 81/490 X

*Primary Examiner*—D. S. Meislin

*Attorney, Agent, or Firm*—Armstrong, Nikaido, Marmelstein, Kubovcik & Murray

[57] ABSTRACT

An improved universal tool structure having a handle holding a tool head connecting means for receiving one of a plurality of tool heads, and a tool head storage case body held within the handle. A push button on the outer surface of the handle has a control member and a biasing spring within the handle. The storage case body fits into the handle from the bottom and has an elongated hole or slot at its top for receiving the control member which is biased to press against the inner surface of the hole to retain the storage case body in the handle. The case body is released by pressing the push button, and a flange at the top of the storage case body butts against an inwardly projecting flange at the handle bottom to retain the case body in the handle.

2 Claims, 3 Drawing Sheets

COMBINATION STRUCTURE OF UNIVERSAL TOOLS

DESCRIPTION OF THE INVENTION

This invention relates to the improvement of the structure of a universal tool having a handle holding a tool connecting means and having a plurality of tool heads stored within the handle.

Screws and screw nuts are of many kinds and are made to greatly varied specifications. In order to cope with and facilitate use of such screws and screw nuts which are varied in size and specification, many different tools are made. As the head of each of these tools is integrally joined with the handle, it is found to be costly to keep a complete set of all tools, consequently resulting in the availability of universal tools in the market. A handle having a tool head connection means is fixed to this kind of universal tool, and installed inside the handle is a storage case body in which the heads of various kinds of tools can be placed. At the time of utilization, one must first take out the storage case body, select a head and fix it to the connection means of the handle. The defect of such a universal tool lies in its method of joining the storage case body to the handle, which is usually in a sandwiched manner between two halves of the handle. It is inconvenient for people to take out the tools, or the storage case body will be loosened and fall off the handle. It is particularly inconvenient for smooth progress of the work being undertaken when, in such a process, the case body falls off the handle. These are defects found in universal tools, which have yet to be improved.

The objective of this invention is to solve the defects as found in universal tools, and provide an improvement of the combination of the handle and tool head storage structure of universal tools. It is achieved through years of continuous research and renovation made by the inventor. Its features lie in having a hollow handle with an opening at its lower portion. A push button is provided on the handle, and inside the handle a control member joined with the push button is provided, to which a biasing spring is fixed. An opening is provided in a corresponding position of the case body to enable the case body to be released when the axis of the push button is pressed to permit the control member to pass through the opening. The case body will then come out by its own weight. However, the case body will not fall out as it is blocked by the flange protruded from the top end of the case body and the flanges protruded from the side of the opening of the handle. This will enable the taking of the heads of various tools out of the case body in which they are stored, and will also enable the case body to be pushed again inside the handle, so as to be retained therein.

The feature of this invention lies in the capability of enabling the retaining and releasing of the case body to which the handle is joined by means of a control exerted by the push button. It will not only not fall out, and also can be utilized in a simple manner.

The structure, utilization, effects and features of this invention will be further described in detail based on the preferred embodiment shown in the attached drawings.

Figure 1:
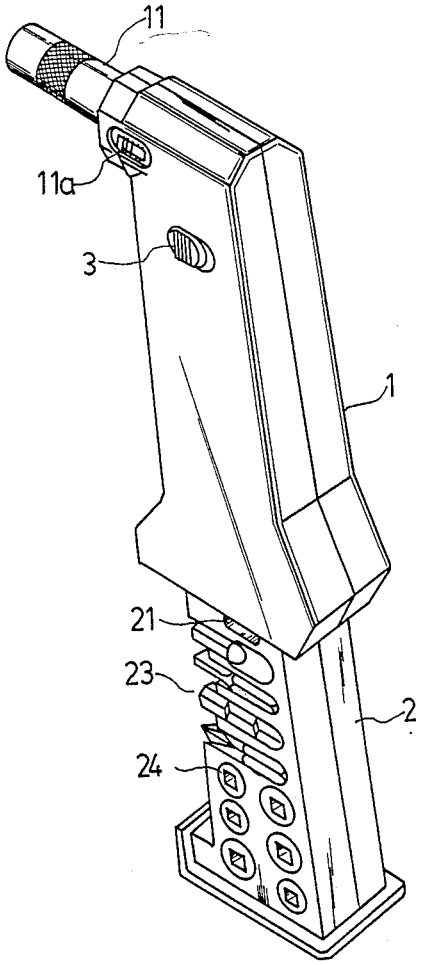
FIG. 1 is a perspective view of the handle.
Figure 2:
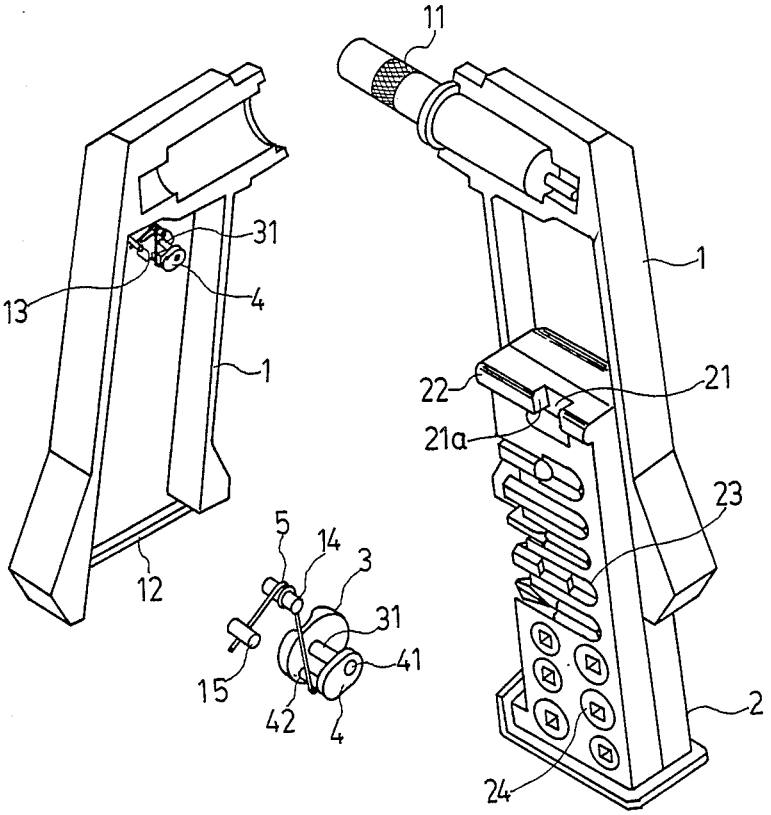
FIG. 2 is a perspective view of the case body.
Figure 3:
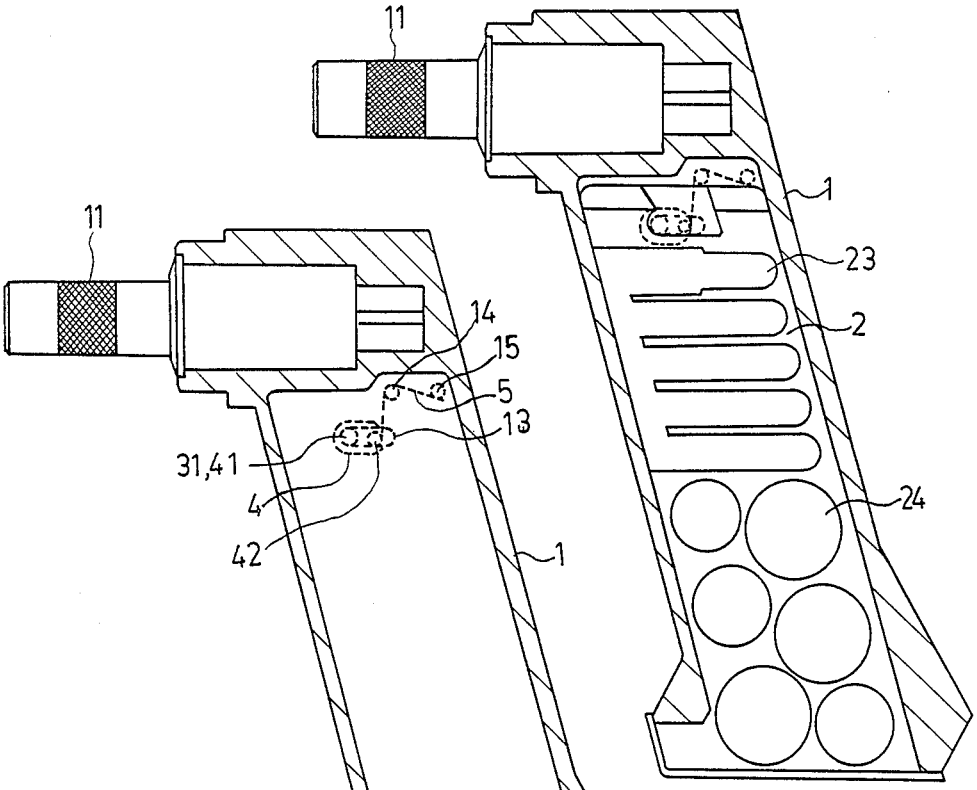
FIG. 3 is a cross section of the handle showing the push button.
Figure 4:
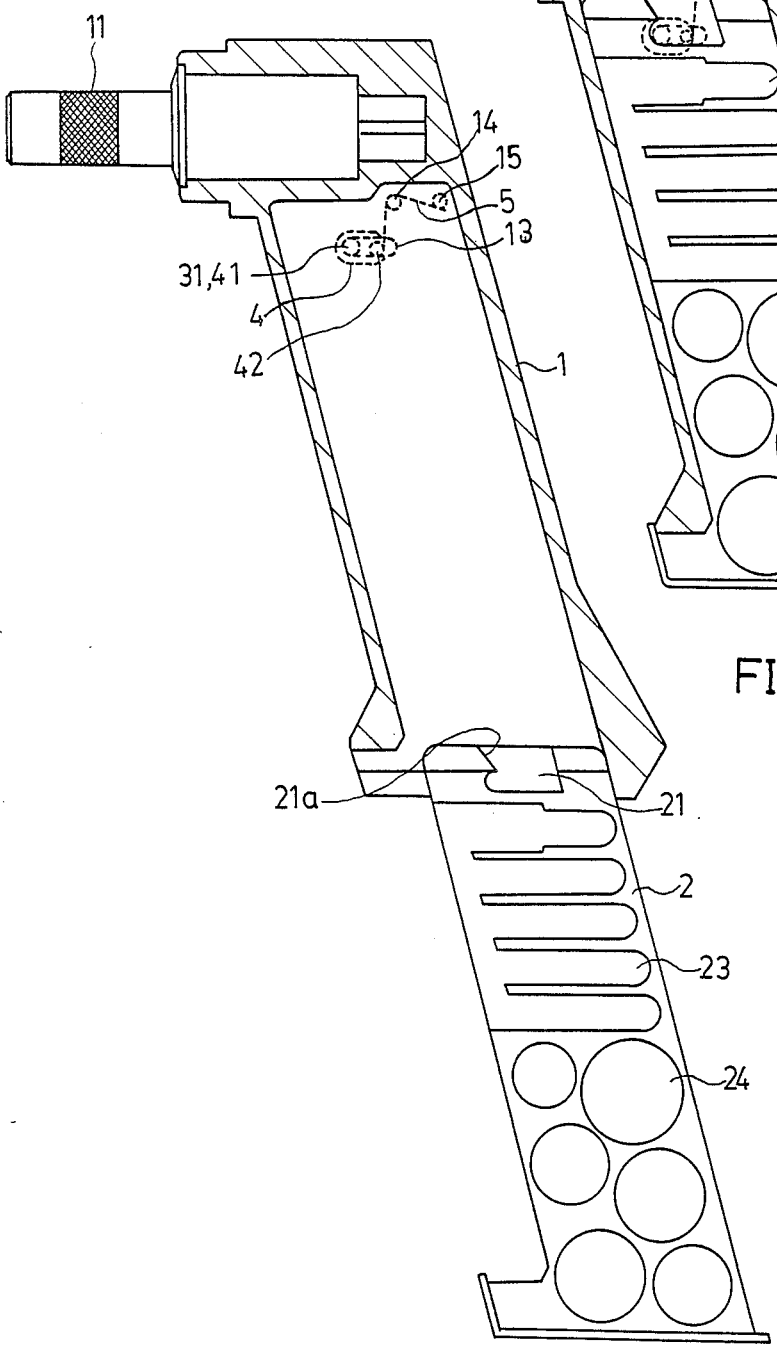
FIG. 4 is a sectional view showing the control member.

Handle 1 is made of two symmetrical halves, having a tool head connection means 11 horizontally protruded at its upper end. The interior of the combination handle is hollow with an opening at its lower end. An inwardly projecting flange 12 is provided at the edge of the opening at the lower end of the two halves of the handle. An elongated guiding hole 13 is provided at an appropriate position close to the upper end of one half of the handle. Two columns 14 and 15 are provided at an appropriate position at the upper portion of the hollow interior wall.

Also provided is a push button 3 and a spring biased control member 4. A linking axis or pin 31 connects the interior of the push button 3 with control member 4. A hole 41 is provided at one end of the control member 4, while a column 42 is provided at another end.

The axis 31 of the push button 3 is positioned in the elongated guiding hole or slot 13 of the handle and protrudes through the interior wall of handle 1. The hole 41 of the control member 4 receives the end of the axis 31. On the other hand, a biasing spring 5 is provided on column 14, while one end of the spring is pressed against the surface of the other column 15, and another end is pressed against the column 42 of tee control member.

Case body 2 is also made of two symmetrical halves. The case body is formed with openings 23 and 24 to accommodate the heads of tools of various shapes and specifications.

An L shaped hole 21 is provided in the case body 2, and the position of the hole corresponds to the control member of the push button. A protruding flange 22 is provided on the two sides of the top end of the case body.

When case body 2 is pushed upward until it reaches the top, the slanting edge 21*a* of the L shaped hole 21 will engage the push button axis 31 and control member 4 which will be caused to press against the interior of hole 21 under the functioning of the biasing spring 5. At this time, the case body 2 will then be retained tightly. When the push button 3 is pushed, its axis will instantly be released from the position in the hole 21 against which it is being pressed. At this time, the case body 2 will be released ad will drop by its own weight. After the dropping of the case body, the flange 22 on its two sides will be butted against the internally projecting flange 12 at the lower end opening edge of the handle 1. At this time, the opening 23 and the hole 24 will be exposed at the lower portion of handle !. The heads or tools which are stored in the opening or hole can be selected according to the requirement of the user. Then, the user may connect the head of the tool to connection means for utilization. For utilization of the tool one may select a clockwise or counterclockwise turning direction, or fix the tool to a non-rotational position of connection means 11 by means of the direction fixing button 11*a*.

What is claimed is:

1. A universal tool comprising:

a handle formed of two substantially symmetrical concave portions joined so as to form a hollow interior space therebetween, said handle including a tool head connecting means projecting from one end thereof and having an opening in an opposite end;

tool head storage case body movably positioned in said handle interior space to extend outwardly through said end opening, said case body having means for accommodating tool heads therein and having an L-shaped opening formed in an intermediate portion of an inner end wall;

a control member movably attached to a lateral interior wall of said handle in a position corresponding to a path of movement of said L-shaped opening so that said control member will pass into said L-shaped opening so said case body is moved into said handle;

a biasing spring mounted on an inner wall of said handle so as to press said control member to engage a side of said of L-shaped opening to thereby retain said case body in said handle; and a push button movably provided on an exterior wall of said of said handle and having a member extending through said handle to engage said control member, said push button urging said control member against said biasing spring to release engagement with said case body to allow movement of said body out of said handle end opening.

2. A universal tool as recited in claim 1 further comprising a first flange formed on said case body inner end wall and a second internally projecting flange formed at said handle end opening so as to abut said first flange and prevent removal of said case body from said handle.

* * * * *